US010842719B1

(12) United States Patent
Picchetti

(10) Patent No.: US 10,842,719 B1
(45) Date of Patent: Nov. 24, 2020

(54) LIQUID-DISPENSING PACIFIER

(71) Applicant: Kyle Picchetti, San Clemente, CA (US)

(72) Inventor: Kyle Picchetti, San Clemente, CA (US)

( * ) Notice: Subject to any disclaimer, the term of this patent is extended or adjusted under 35 U.S.C. 154(b) by 184 days.

(21) Appl. No.: 16/208,678

(22) Filed: Dec. 4, 2018

(51) Int. Cl.
*A61J 11/00* (2006.01)
*A61J 7/00* (2006.01)

(52) U.S. Cl.
CPC ..... *A61J 11/005* (2013.01); *A61J 7/0053* (2013.01); *A61J 11/0005* (2013.01)

(58) Field of Classification Search
CPC . A61J 11/005; A61J 7/0053; A61J 7/00; A61J 11/0005; A61J 11/00; A61J 11/002; A61J 11/0055
See application file for complete search history.

(56) References Cited

U.S. PATENT DOCUMENTS 5,013,321 A 5/1991 MacVane
5,123,915 A 6/1992 Miller
5,176,705 A 1/1993 Noble
D380,270 S 6/1997 Rekar
5,662,684 A 9/1997 Caso
5,843,030 A * 12/1998 Van Der Merwe ... A61J 7/0053 604/77
6,110,193 A * 8/2000 Chen ..... A61J 7/0046 606/234
6,454,788 B1 * 9/2002 Ashton ..... A61J 17/001 606/234
2004/0188372 A1 * 9/2004 Ruth ..... A61J 11/0005 215/11.4
2007/0027479 A1 2/2007 Carter
2012/0022446 A1 * 1/2012 Desai ..... A61J 7/0053 604/77
2012/0277794 A1 * 11/2012 Kountotsis ..... A61B 5/6802 606/234
2019/0110958 A1 * 4/2019 Addelia, II ..... A61B 5/746

FOREIGN PATENT DOCUMENTS

WO 2007016523 2/2007

* cited by examiner

*Primary Examiner* — Katrina M Stransky
(74) *Attorney, Agent, or Firm* — Kyle A. Fletcher, Esq.

(57) ABSTRACT

The liquid-dispensing pacifier comprises a nipple, a fluid dispenser, and a guard. The guard prevents the liquid-dispensing pacifier from being swallowed by the baby. The nipple is shaped to resemble a female human teat and provides one or more apertures through which a fluid may exit the nipple from a chamber within the nipple. As non-limiting examples, the fluid may be breast milk or formula. The fluid is introduced into the nipple from the fluid dispenser. The fluid dispenser may be a reservoir or syringe that is coupled to the nipple. Fluid may travel from the reservoir to the chamber in the nipple via a valve or feeding tube. The valve may be opened by sucking action of the baby. The syringe may inject fluid into the chamber through one or more apertures, values, or tubes.

18 Claims, 4 Drawing Sheets

LIQUID-DISPENSING PACIFIER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of infant equipment, more specifically, a liquid-dispensing pacifier.

SUMMARY OF INVENTION

The liquid-dispensing pacifier comprises a nipple, a fluid dispenser, and a guard. The guard prevents the liquid-dispensing pacifier from being swallowed by the baby. The nipple is shaped to resemble a female human teat and provides one or more apertures through which a fluid may exit the nipple from a chamber within the nipple. As non-limiting examples, the fluid may be breast milk or formula or other types of materials of varying viscosity, which may include a gel. The fluid is introduced into the nipple from the fluid dispenser. The fluid dispenser may be a reservoir or syringe that is coupled to the nipple. Fluid may travel from the reservoir to the chamber in the nipple via a valve or feeding tube. The valve may be opened by sucking action of the baby. The syringe may inject fluid into the chamber through one or more apertures, values, or tubes.

An object of the invention is to provide a pacifier for a baby.

Another object of the invention is to dispense a fluid from the pacifier nipple.

A further object of the invention is to introduce the fluid into the nipple from a reservoir or syringe, Yet another object of the invention is to open a valve between the nipple and reservoir when the baby sucks on the nipple.

These together with additional objects, features and advantages of the liquid-dispensing pacifier will be readily apparent to those of ordinary skill in the art upon reading the following detailed description of the presently preferred, but nonetheless illustrative, embodiments when taken in conjunction with the accompanying drawings.

In this respect, before explaining the current embodiments of the liquid-dispensing pacifier in detail, it is to be understood that the liquid-dispensing pacifier is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the liquid-dispensing pacifier.

It is therefore important that the claims be regarded as including such equivalent construction insofar as they do not depart from the spirit and scope of the liquid-dispensing pacifier. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
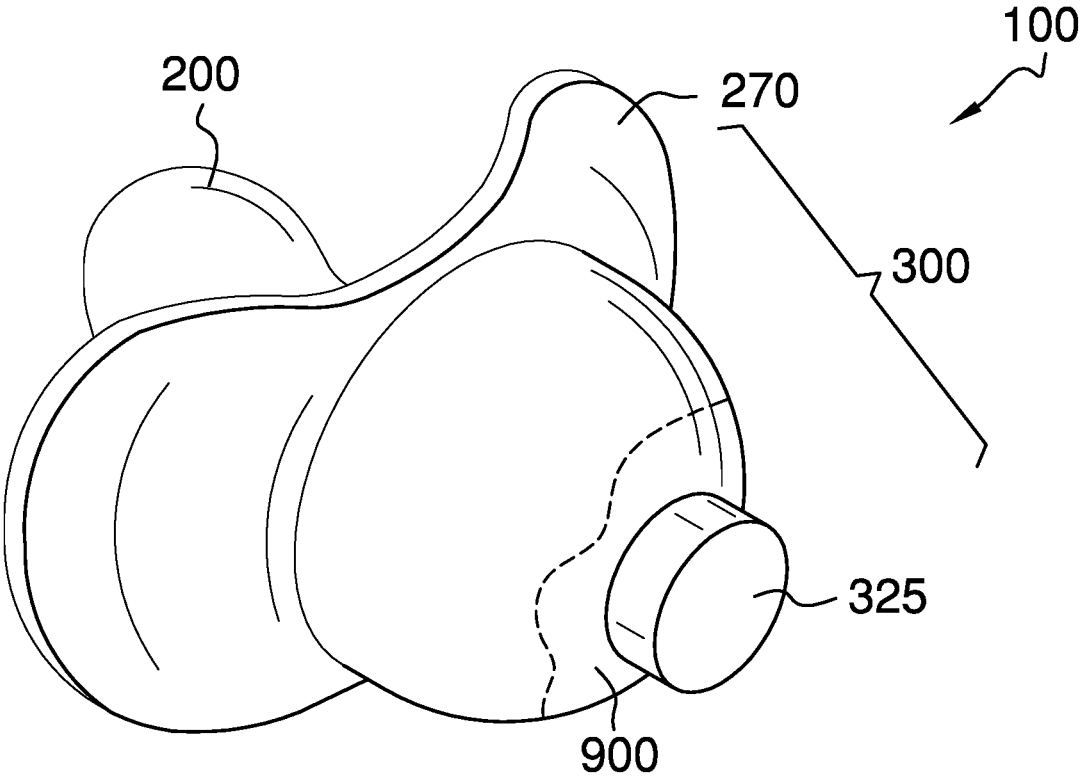
FIG. 1 is a perspective view of an embodiment of the disclosure.
Figure 2:
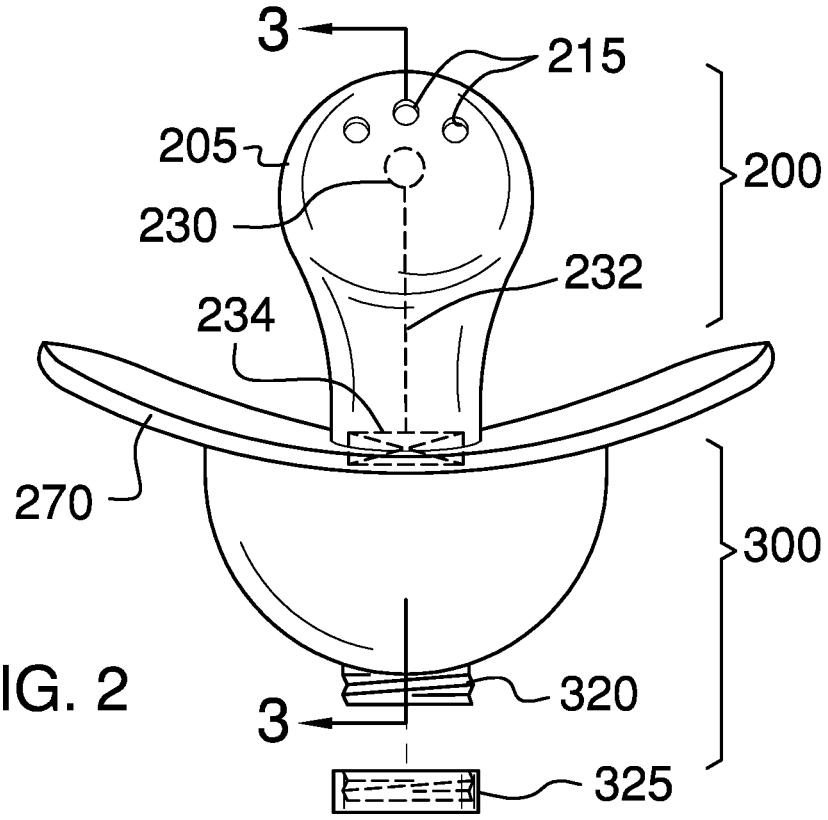
FIG. 2 is a bottom view of an embodiment of the disclosure.
Figure 3:
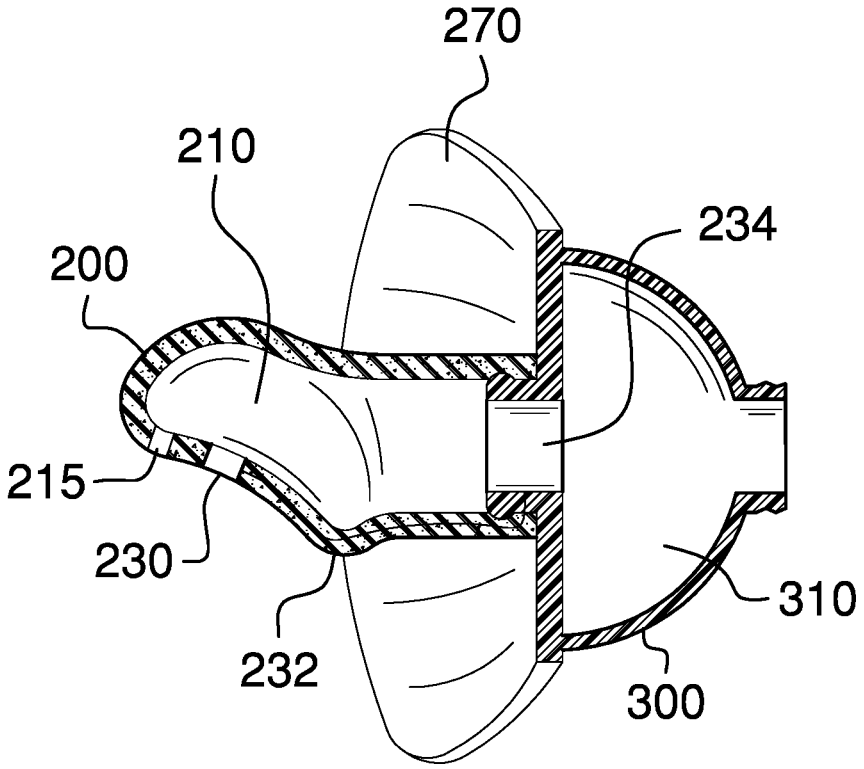
FIG. 3 is a cross-sectional view of an embodiment of the disclosure across 3-3 as shown in FIG. 2.
Figure 4:
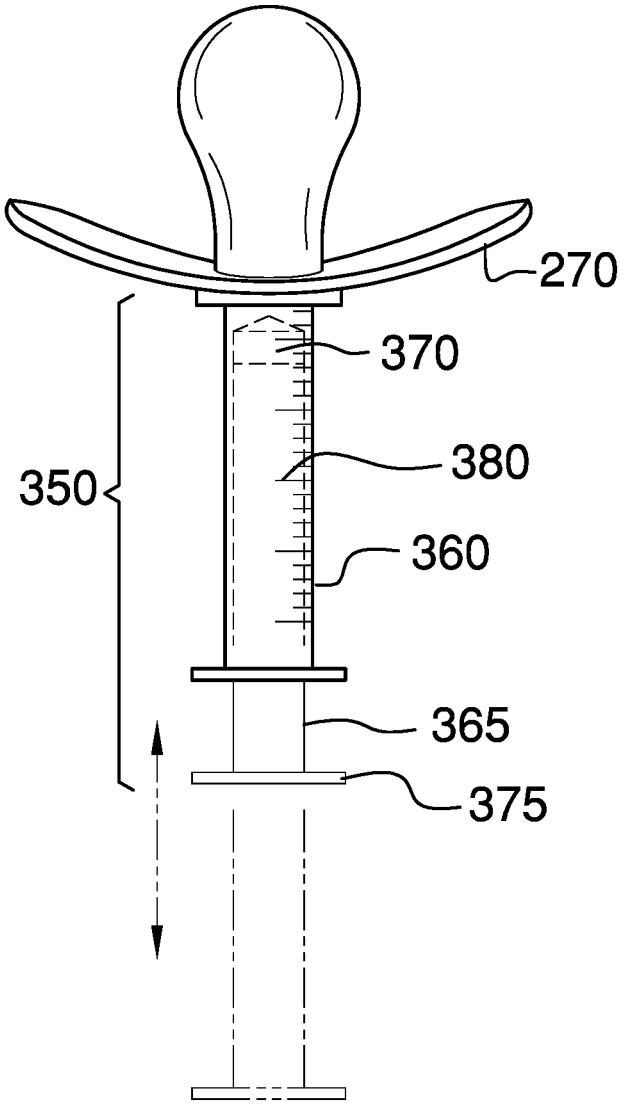
FIG. 4 is a top view of an alternative embodiment of the disclosure illustrating the syringe.
Figure 5:
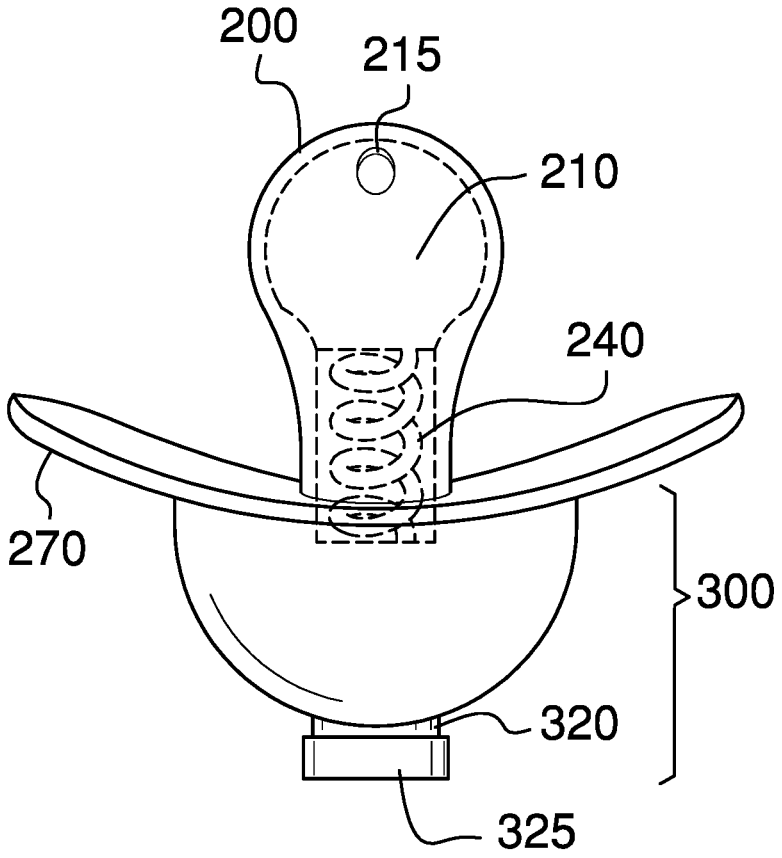
FIG. 5 is a bottom view of an alternative embodiment of the disclosure illustrating the feeding tube.

Detailed reference will now be made to a first potential embodiment of the disclosure, which is illustrated in FIGS. 1 through 5.

The liquid-dispensing pacifier 100 (hereinafter invention) comprises a nipple 200, a fluid dispenser 300, and a guard 270. The invention 100 is a toy adapted for a baby to suck on. The invention 100 may deliver a fluid 900 from the fluid dispenser 300 via the nipple 200. As non-limiting examples, the fluid 900 may be breast milk or formula.

The nipple 200 may be a cylindrical feature of the invention 100 that is adapted to resemble a female human teat. The nipple 200 may be made from a flexible material. As non-limiting examples, the nipple 200 may be rubber, plastic, or silicone. The nipple 200 may comprise a bulbous end 205. The bulbous end 205 may be adapted to make it easier for the baby to keep the nipple 200 in their mouth. The interior of the nipple 200 may be hollow, comprising a chamber 210. The bulbous end 205 may comprise one or more fluid apertures 215. The one or more fluid apertures 215 may allow the fluid 900 located within the chamber 210 to flow out of the nipple 200.

The fluid dispenser 300 may hold the fluid 900 and may pass the fluid 900 to the nipple 200 in a controlled manner. As non-limiting examples, passing the fluid 900 to the nipple 200 in a controlled manner may indicate that the fluid 900 is passed to the nipple 200 when demanded by the baby or that the fluid 900 is passed to the nipple 200 under control of an adult. The fluid 900 may pass from the fluid dispenser 300 to the nipple 200 via one or more apertures, valves, or tubes.

The guard 270 may be a curved shield surrounding the nipple 200. The guard 270 may prevent the invention 100 from accidently being swallowed.

In some embodiments, the nipple 200 may comprise a pressure sensor 230, a dispensing valve 234, and a link 232. The pressure sensor 230 may be an area of the nipple 200 that is adapted to move when the baby sucks on the nipple 200. As a non-limiting example, the pressure sensor 230 may be a disk in contact with the wall of the nipple 200. The dispensing valve 234 may control the flow of the fluid 900 from the fluid dispenser 300 into the chamber 210 located within the nipple 200. The link 232 may couple at one end to the pressure sensor 230 and at the other end to the dispensing valve 234 such that mechanical pressure applied to the pressure sensor 230 when the nipple 200 is sucked may move the link 232 and may cause the dispensing valve 234 to open and start the flow of the fluid 900 from the fluid dispenser 300 to the chamber 210. The link 232 may return to its original position when pressure is removed and may allow the dispensing valve 234 to close and stop the flow of the fluid 900 from the fluid dispenser 300 to the chamber 210.

In some embodiments, the nipple 200 may comprise a feeding tube 240. The feeding tube 240 may be a tube leading from the fluid dispenser 300 to the chamber 210. The feeding tube 240 may limit the rate at which the fluid 900 flows from the fluid dispenser 300 into the chamber 210. As a non-limiting example, the feeding tube 240 may be spiral tubing with a diameter that limits the fluid flow through the tubing to less than a predefined flow rate.

In some embodiments, the fluid dispenser 300 may comprise a reservoir 310, a neck 320, and a cap 325. The reservoir 310 may be a hemispherical, watertight container adjacent to the nipple 200. The reservoir 310 may hold the fluid 900 before the fluid 900 is introduced into the nipple 200 for consumption. The neck 320 may be a cylindrical opening to the reservoir 310 through which the fluid 900 may be added to or removed from the reservoir 310. The outside of the neck 320 may be threaded for coupling to the cap 325. The cap 325 may be a removable covering for the neck 320. The inside of the cap 325 may be threaded with a thread that complements the thread on the neck 320 such that the cap 325 may be installed and removed by twisting one direction of the other. When installed, the cap 325 may form a watertight seal with the neck 320 and may prevent the fluid 900 for exiting the reservoir 310.

In some embodiments, the reservoir 310 may be made from a resilient material that flexes when pressed. Applying external pressure to the reservoir 310 may increase the internal pressure of the reservoir 310 and may force the fluid 900 from the reservoir 310 into the nipple 200.

In some embodiments, the fluid dispenser 300 may comprise a syringe 350. The syringe 350 may be a manually-operated reciprocating pump comprising a barrel 360 and a plunger 365. The barrel 360 may be a hollow cylinder that forms an outside wall of the syringe 350. One end of the barrel 360 may couple to the nipple 200 and/or the guard 270. The other end of the barrel 360 may be open to allow the plunger 365 to be inserted into the barrel 360. In some embodiments, the barrel 360 may comprise indicia 380 to indicate the volume of fluid contained within the syringe 350. One end of the plunger 365 may comprise a seal 370. The other end of the plunger 365 may comprise a handle 375. The seal 370 may be a movable, watertight contact between the plunger 365 and the inside of the barrel 360. As a non-limiting example, the seal 370 may comprise an O-ring that couples to the end of the plunger 365 and has an outside diameter that matches the inside diameter of the barrel 360. The handle 375 may be a grasping point for operating the syringe 350. The syringe 350 may draw the fluid 900 into the barrel 360 as the plunger 365 is withdrawn from the barrel 360 and may expel the fluid 900 from the barrel 360 as the plunger 365 is pushed into the barrel 360.

In some embodiments, the syringe 350 may be detachable from the rest of the invention 100. Detaching the syringe 350 may facilitate cleaning the syringe 350 and reloading the syringe 350. As a non-limiting example, the end of the barrel 360 opposite the plunger 365 may screw into a threaded aperture on the nipple 200.

In use, the fluid dispenser 300 may be filled with the fluid 900, non-limiting examples of which include the breast milk and the formula. The fluid dispenser 300 may be filled either by removing the cap 325, pouring the fluid 900 into the reservoir 310, and replacing the cap 325 or by introducing the fluid 900 into the barrel 360 of the syringe 350. The nipple 200 may be placed into the mount of the baby. As the baby suckles, small amounts of the fluid 900 may be released into the nipple 200—either due to the sucking or due to the adult gently and occasionally pressing the plunger 365. The fluid 900 released into the nipple 200 may be sucked from the nipple 200 via the one or more fluid apertures 215 and may be consumed by the baby. The fluid 900 consumed by the baby may supplement a normal feeding schedule and may help pacify the baby.

Definitions

As used in this disclosure, an "aperture" is an opening in a surface. Aperture may be synonymous with hole, slit, crack, gap, slot, or opening.

As used herein, the words "couple", "couples", "coupled" or "coupling", refer to connecting, either directly or indirectly, and does not necessarily imply a mechanical connection.

As used in this disclosure, a "cylinder" is a geometric structure defined by two identical flat and parallel ends, also commonly referred to as bases, which are circular in shape and connected with a single curved surface which may be referred to as the face. The axis of the cylinder is formed by the straight line that connects the center of each of the two identical flat and parallel ends of the cylinder. Unless otherwise stated within this disclosure, the term cylinder specifically indicates a right cylinder, which is defined as a cylinder wherein the curved surface perpendicularly intersects with the two identical flat and parallel ends.

As used in this disclosure, a "diameter" of an object is a straight line segment that passes through the center (or center axis) of an object. The line segment of the diameter is terminated at the perimeter or boundary of the object through which the line segment of the diameter runs.

As used in this disclosure, a "disk" is a cylindrically shaped object with parallel opposing sides. A disk generally has a thickness (as measured from flat side to flat side) that is less than the radius of the cylinder.

As used in this disclosure, "flexible" refers to an object or material which will deform when a force is applied to it, which will not return to its original shape when the deforming force is removed, and which may not retain the deformed shape caused by the deforming force.

As used in this disclosure, a "handle" is an object by which a tool, object, or door is held or manipulated with the hand.

As used in this disclosure, the term "indicia" refers to a set of markings that identify a sentiment.

As used herein, "inside diameter" refers to a measurement made on a hollow object. Specifically, the inside diameter is the distance from one inside wall to the opposite inside wall. If the object is round, then the inside diameter is a true diameter, however the term may also be used in connection with a square object in which case the inside diameter is simply the narrowest inside measurement that passes through the center of the object.

As used in this disclosure, the word "interior" is used as a relational term that implies that an object is located or contained within the boundary of a structure or a space.

As used herein, "outside diameter" refers to a measurement made on an object. Specifically, the outside diameter is the distance from one point on the outside of the object to a point on the opposite side of the object along a line passing through the center of the object. The term outside diameter is frequently used in conjunction with round objects such as hollow conduits in which case the outside diameter is a true diameter, however the term may also be used in connection with a square object in which case the outside diameter is simply the widest outside measurement that passes through the center of the conduit.

As used in this disclosure, a "plunger" is a cylindrical piston that is used to pump fluids out of a syringe.

As used in this disclosure, a "pump" is a mechanical or electromechanical device that uses suction or pressure to raise or move fluids, compress fluids, or force a fluid into an inflatable object. As non-limiting examples, fluids may include both liquids, such as water, and gases, such as air.

As used in this disclosure, a "reservoir" refers to a container or containment system that is configured to store a liquid.

As used in this disclosure, "resilient" or "semi-rigid" refer to an object or material which will deform when a force is applied to it and which will return to its original shape when the deforming force is removed.

As used in this disclosure, a "spiral" describes a locus of points within a plane moving around a fixed center wherein the locus of points moves monotonically increasing manner away from the center.

As used in this disclosure, a "syringe" is a device that is used to measure fluids. In a medical setting, a syringe is used to inject fluids into a body or draw fluids from a body in a measurable manner. A syringe generally comprises a hollow cylindrical barrel and a plunger.

As used in this disclosure, a "tube" is a hollow cylindrical device that is used for transporting liquids and gases. In this disclosure, the terms inner diameter and outer diameter are used as they would be used by those skilled in the plumbing arts. The line that connects the center of the first base of the cylinder to the center of the second base of the cylinder and is equidistant from the outer surface of the tube for its entire length is referred to as the centerline of the tube. When two tubes share the same centerline they are said to be aligned. When the centerlines of two tubes are perpendicular to each other, the tubes are said to be perpendicular to each other. As used here, "tubing" refers to a tube that is flexible or resilient.

As used in this disclosure, a "valve" is a device that is used to control the flow of a fluid (gas or liquid) through a pipe or to control the flow of a fluid into and out of a container. Some valves may have multiple ports and may allow the diverting or mixing of fluids.

As used herein, the word "watertight" refers to a barrier that is impermeable to water.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A liquid-dispensing pacifier comprising:
a nipple, a fluid dispenser, and a guard;
wherein the liquid-dispensing pacifier is a toy adapted for a baby to suck on;
wherein the liquid-dispensing pacifier delivers a fluid from the fluid dispenser via the nipple;
wherein the nipple comprises a pressure sensor, a dispensing valve, and a link;
wherein the pressure sensor is an area of the nipple that is adapted to move when the baby sucks on the nipple.

2. The liquid-dispensing pacifier according to claim 1
wherein the nipple is a cylindrical feature of the liquid-dispensing pacifier that is adapted to resemble a female human teat;
wherein the nipple is made from a flexible material.

3. The liquid-dispensing pacifier according to claim 2
wherein the nipple is rubber, plastic, or silicone;
wherein the nipple comprises a bulbous end;
wherein the bulbous end is adapted to make it easier for the baby to keep the nipple in their mouth;
wherein the interior of the nipple is hollow, comprising a chamber;
wherein the bulbous end comprises one or more fluid apertures;
wherein the one or more fluid apertures allow the fluid located within the chamber to flow out of the nipple.

4. The liquid-dispensing pacifier according to claim 3
wherein the fluid dispenser holds the fluid and passes the fluid to the nipple in a controlled manner;
wherein the fluid passes from the fluid dispenser to the nipple via one or more apertures, valves, or tubes.

5. The liquid-dispensing pacifier according to claim 4
wherein the guard is a curved shield surrounding the nipple;
wherein the guard prevents the liquid-dispensing pacifier from accidently being swallowed.

6. The liquid-dispensing pacifier according to claim 5
wherein the pressure sensor is a disk in contact with the wall of the nipple;

wherein the dispensing valve controls the flow of the fluid from the fluid dispenser into the chamber located within the nipple;

wherein the link couples at one end to the pressure sensor and at the other end to the dispensing valve such that mechanical pressure applied to the pressure sensor when the nipple is sucked moves the link and causes the dispensing valve to open and start the flow of the fluid from the fluid dispenser to the chamber;

wherein the link returns to its original position when pressure is removed and allows the dispensing valve to close and stop the flow of the fluid from the fluid dispenser to the chamber.

7. The liquid-dispensing pacifier according to claim 5 wherein the nipple comprises a feeding tube;

wherein the feeding tube is a tube leading from the fluid dispenser to the chamber;

wherein the feeding tube limits the rate at which the fluid flows from the fluid dispenser into the chamber.

8. The liquid-dispensing pacifier according to claim 7 wherein the feeding tube is spiral tubing with a diameter that limits the fluid flow through the tubing to less than a predefined flow rate.

9. The liquid-dispensing pacifier according to claim 8 wherein the fluid dispenser comprises a reservoir, a neck, and a cap;

wherein the reservoir is a hemispherical, watertight container adjacent to the nipple;

wherein the reservoir holds the fluid before the fluid is introduced into the nipple for consumption.

10. The liquid-dispensing pacifier according to claim 9 wherein the neck is a cylindrical opening to the reservoir through which the fluid is added to or removed from the reservoir;

wherein the outside of the neck is threaded for coupling to the cap.

11. The liquid-dispensing pacifier according to claim 10 wherein the cap is a removable covering for the neck;

wherein the inside of the cap is threaded with a thread that complements the thread on the neck such that the cap is installed and removed by twisting one direction of the other;

wherein when installed, the cap forms a watertight seal with the neck and prevents the fluid for exiting the reservoir.

12. The liquid-dispensing pacifier according to claim 11 wherein the reservoir is made from a resilient material that flexes when pressed;

wherein applying external pressure to the reservoir increases the internal pressure of the reservoir and forces the fluid from the reservoir into the nipple.

13. The liquid-dispensing pacifier according to claim 5 wherein the fluid dispenser comprises a syringe;

wherein the syringe is a manually-operated reciprocating pump comprising a barrel and a plunger;

wherein the barrel is a hollow cylinder that forms an outside wall of the syringe;

wherein one end of the barrel couples to the nipple and/or the guard;

wherein the other end of the barrel is open to allow the plunger to be inserted into the barrel.

14. The liquid-dispensing pacifier according to claim 13 wherein the barrel comprises indicia to indicate the volume of fluid contained within the syringe;

wherein one end of the plunger comprises a seal;

wherein the other end of the plunger comprises a handle;

wherein the seal is a movable, watertight contact between the plunger and the inside of the barrel.

15. The liquid-dispensing pacifier according to claim 14 wherein the seal comprises an O-ring that couples to the end of the plunger and has an outside diameter that matches the inside diameter of the barrel.

16. The liquid-dispensing pacifier according to claim 15 wherein the handle is a grasping point for operating the syringe;

wherein the syringe draws the fluid into the barrel as the plunger is withdrawn from the barrel and expels the fluid from the barrel as the plunger is pushed into the barrel.

17. The liquid-dispensing pacifier according to claim 16 wherein the syringe is detachable from the rest of the liquid-dispensing pacifier.

18. The liquid-dispensing pacifier according to claim 17 wherein the end of the barrel opposite the plunger screws into a threaded aperture on the nipple.

* * * * *